US005695415A

United States Patent [19]

Docherty et al.

[11] Patent Number: 5,695,415

[45] Date of Patent: Dec. 9, 1997

[54] BASKETBALL BACKBOARD AIMING DEVICE

[75] Inventors: Michael E. Docherty, Novi; Curtis J. Bailey, Birmingham, both of Mich.

[73] Assignee: Sundberg-Ferar, Inc., Walled Lake, Mich.

[21] Appl. No.: 704,290

[22] Filed: Aug. 28, 1996

[51] Int. Cl.[6] ..... A63B 69/00

[52] U.S. Cl. ..... 473/447; 40/453; 40/454; 473/481

[58] Field of Search ..... 473/447–449, 473/479, 480, 481–487, 2; 40/453, 454

[56] References Cited

U.S. PATENT DOCUMENTS

| | | | |
|---|---|---|---|
| 1,297,815 | 3/1919 | Englehart . | |
| 2,085,206 | 6/1937 | Holmdahl | 473/487 |
| 2,831,284 | 4/1958 | Thompson | 40/453 |
| 2,850,825 | 9/1958 | Grants | 40/453 |
| 3,457,548 | 7/1969 | Mazurkiewicz | 40/453 |
| 3,463,593 | 8/1969 | Horan . | |
| 3,468,545 | 9/1969 | Anderson | 40/454 X |
| 4,547,141 | 10/1985 | Ruschmann . | |
| 4,643,515 | 2/1987 | Upatnieks . | |
| 4,711,512 | 12/1987 | Upatnieks . | |
| 4,882,676 | 11/1989 | Van De Kop et al. | 473/2 |
| 5,161,979 | 11/1992 | Sekiguchi | 40/453 X |
| 5,342,041 | 8/1994 | Agulnek et al. | 473/447 X |
| 5,451,181 | 9/1995 | Denoux | 40/454 X |

*Primary Examiner*—Paul E. Shapiro

*Attorney, Agent, or Firm*—Gifford, Krass, Groh, Sprinkle, Patmore, Anderson & Citkowski, P.C.

[57] ABSTRACT

A basketball backboard aiming device. The device includes a backboard member for attachment to a standard basketball hoop. The backboard has a front, planar surface. A linear array of indicia are disposed along the backboard, the array including a plurality of individual targets. Each of the targets is selectively viewable by a shooter disposed along a unique axis forming a preselected angle with respect to the plane of the backboard. One side of the angle is defined by a line of sight extending from the shooter to the target and the second side by the plane of the backboard. The selectively viewable target provides an aiming point for a shooter disposed anywhere along the line of sight when said player attempts a bank shot.

10 Claims, 2 Drawing Sheets

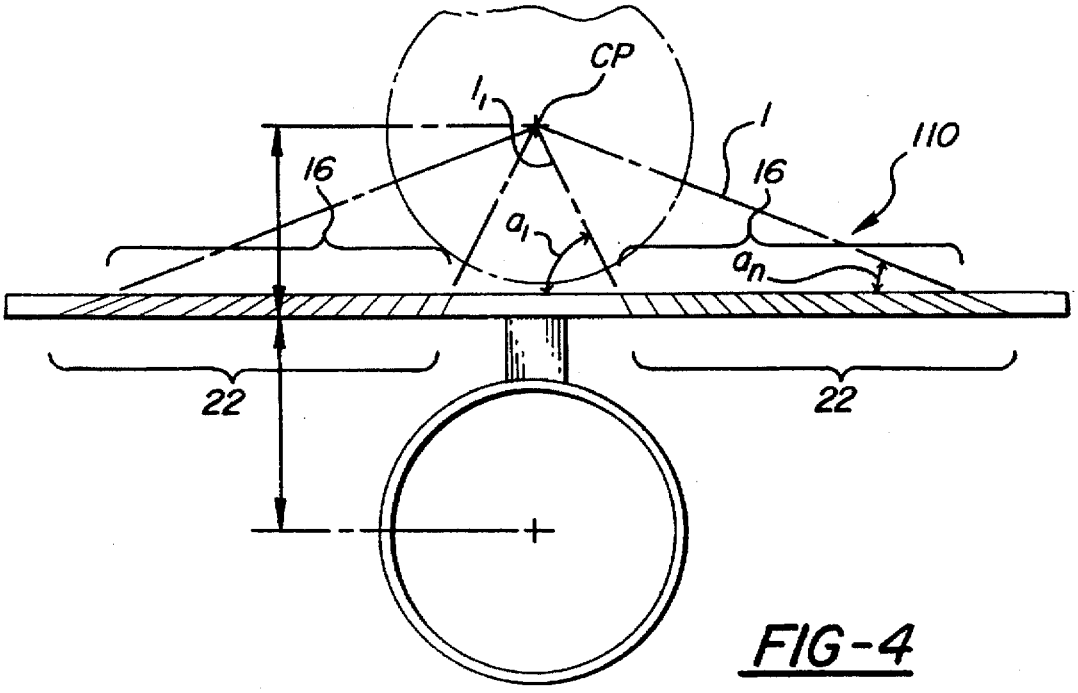
FIG-4
FIG-5
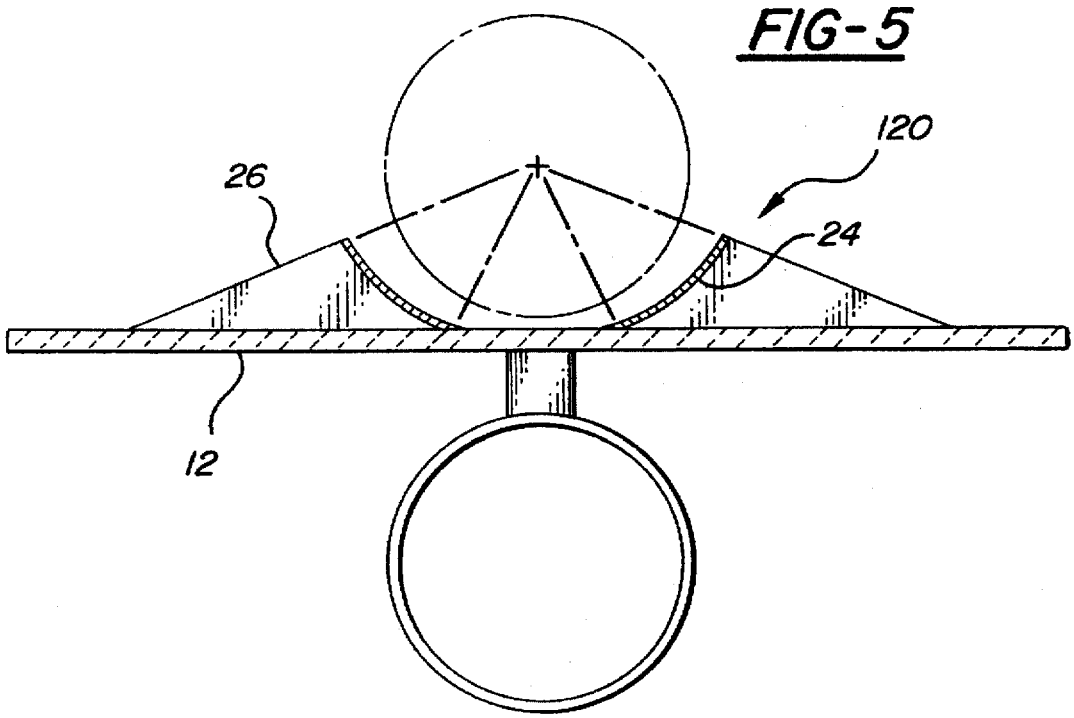

BASKETBALL BACKBOARD AIMING DEVICE

CROSS-REFERENCE TO RELATED APPLICATIONS

This application claims priority of U.S. Provisional Application Ser. No. 60/002,875 filed Aug. 28, 1995, and Ser. No. 60/010,175 filed Jan. 18, 1996.

1. Field of the Invention

This invention concerns the field of basketball backboards and, more particularly, such a backboard having a selectively viewable array of target indicia disposed thereon.

2. Description of the Relevant Prior Art

Basketball is one of the most widely played athletic games in the U.S. today. Its popularity is, in part, due to the fact that the game can be informally played by only a few players while utilizing relatively simple and inexpensive equipment. For example, a pickup game can be played outdoors on any hard surface. In addition to the ball, the only other required piece of equipment is the backboard and hoop assembly which can be mounted at the correct height onto a wall, post, or other convenient mounting surface.

A great many basketball shots are not aimed to fall directly through the hoop, but, rather, are banked off the backboard to fall into the hoop. However, basketball players, and especially young beginners, have difficulty learning properly to use the backboard to accomplish a bank shot. Skill at bank shot greatly contributes to a player's success in making baskets. Thus, basketball coaches at all levels stress the importance of using the backboard for increasing shot percentages.

However, the ability to successfully score baskets from bank shots is a relatively difficult skill to develop. Instead of intuitively aiming the ball directly at the basket, the player must judge both the angle at which the shot should be banked to fall into the basket, and also the spot on the backboard where the shot should be aimed. Thus, many players either do not even attempt to use the backboard, thus severely limiting their scoring skills, or never learn where properly to bank the ball on the backboard to make successful bank shots.

A variety of basketball practice devices exist which have as their object the improvement of the player's aiming skills. Examples of such prior art include U.S. Pat. Nos. 4,836,539; 4,506,886; 4,244,569; and 3,825,257. However, these devices are intended to assist the player in successfully throwing the ball directly into the basket; that is, they do not address the problem of improving bank shots and, consequently, a player's overall shot percentage.

Clearly, there exists a need for a practice device which would assist the player in improving her ability to make successful bank shots. There is a particular need for such a device which is inexpensive and simple to manufacture, and which can be sold as a piece of original equipment, or retrofitted onto existing basketball backboards.

SUMMARY OF THE INVENTION

The device of the present invention will allow players to see at a glance where to aim the ball at the backboard to accomplish a successful bank shot. The invention is a position sensitive target system that displays the correct target regardless of the player's position on the court. The device includes a backboard member of conventional size and shape for attachment to a standard basketball hoop. The backboard member includes a front surface which defines a plane. A linear army of target indicia is disposed along the backboard. The array includes a plurality of targets, each of the targets being selectively viewable by a shooter who has a preselected angular relationship with respect to the target. That is, the shooter's line of sight to the target must be at a predetermined angle with respect to the backboard or the target will not be visible from that position. Preferably, the series of angles preselected for the array of target members gradually diverges from a centerpoint of the array to the endpoints thereof. The angles are selected such that a ball thrown by a player standing anywhere on the court toward whatever target is visible on the backboard on the present invention will hit the backboard at the correct angle to rebound into the basket.

In a preferred embodiment of the present invention, the backboard includes a horizontally disposed linear array. In another preferred embodiment, a two dimensional array is disposed on the backboard member including a first plurality of target members horizontally arrayed thereacross, and a second plurality of target members vertically arrayed thereupon. Again, the vertically arrayed target members will be visible only when viewed from the correct viewing angle; this embodiment provides for finer adjustment and accounts for such variables as the player's height, and his distance from the basket.

Thus, with the device of the present invention, the visible target will move as required to provide the correct location for a bank shot as a player moves around the court. If the player succeeds in hitting the visible target on the backboard, then the ball should bank into the basket. If the player misses the target, she should be able to see in which direction the shot missed, thereby providing feedback for a true training effect. As players gain experience in using the device and the feedback it provides on the correct bank location, their shot percentages will improve. Moreover, this training effect will carry forward even when the player plays with a conventional backboard through accelerated muscle memory.

In a particular embodiment of the backboard of the present invention, a lenticular array, such as a sheet of lenticular plastic film, is disposed between the indicia and the player. The lenticular array is operational to permit selective viewing of a single target member depending, again, on the player's angular relationship with respect to the backboard.

In yet another preferred embodiment, the backboard is substantially transparent and includes a plurality of opaque film layers. For example, three opaque film layers may be used, one on the front of the backboard, one on the back, and one embedded in the backboard medial the front and back. A plurality of slit like apertures are formed in each opaque layer. The apertures of adjacent layer pairs partially overlap in a staggered fashion so as to create angled viewing slits through the backboard. The apparent angle of each slit is controlled by the amount of overlap between adjacent apertures. Again, this angle is varied in the manner described with respect to the louver embodiment to permit selective viewing of various targets as a player moves around the court.

In yet another embodiment, the backboard includes a holographic film disposed thereon, said holographic film including an interference pattern which permits the selective viewing as described above. Preferably, the holographic film is formed by microembossing a diffraction pattern thereon from a master embossing die, in a manner known in the art.

See, for example, U.S. Pat. No. 4,547,141, the disclosure of which is hereby incorporated by reference.

In all of these embodiments, the backboard may be provided as a retrofit for an existing backboard. In particular, if the existing backboard is clear glass or acrylic (as most are), the lenticular, layered, or holographic film can be removably disposed behind the existing backboard structure so that it will show through. Alternatively, the film could be provided with a coating of pressure sensitive adhesive for permanent mounting to the rear surface of an existing transparent backboard.

In another embodiment, a plurality of louvers are disposed between the indicia and the player. The louvers are disposed vertically, and at varying angles with respect to the backboard so that the targets are selectively visible as described above. Preferably, each target member is disposed between an adjacent pair of louvers which each have a preselected angular orientation with respect to the backboard so that the target member will be visible only when the player's line of sight has the correct angular relationship with respect to the backboard. That is, when measured moving from the midpoint of the array of indicia toward either endpoint thereof, the angles at which successive louvers are oriented with respect to the backboard will increase. The louvers may be provided in the form of conventional slats, or as mini louvers in the form of microlouver film disposed behind the backboard in curved fashion so as to form the gradually increasing angles.

The backboard apparatus of the present invention is intended as a training aid. Preferably, the array of indicia are not visible during an actual game. The backboard can be made removable as previously mentioned, or in yet another embodiment of the apparatus of the present invention, it may further include means for simultaneously blocking display of all of the target members at one time.

The backboard of the present invention may further comprise nontarget indicia, such as graphic patterns, slogans, etc., displayed on the backboard. By making selective members of the non-target indicia visible as players move around the court, the non-target indicia may appear to move, thus creating an animation effect.

BRIEF DESCRIPTION OF THE DRAWINGS

The following detailed description is best understood by reference to the following drawings, in which:

FIG. 4 is a schematic plan view of one embodiment of the backboard of the present invention;

FIG. 5 is a schematic plan view of another embodiment of the backboard of the present invention.

DETAILED DESCRIPTION OF THE PREFERRED EMBODIMENTS

Figure 1:
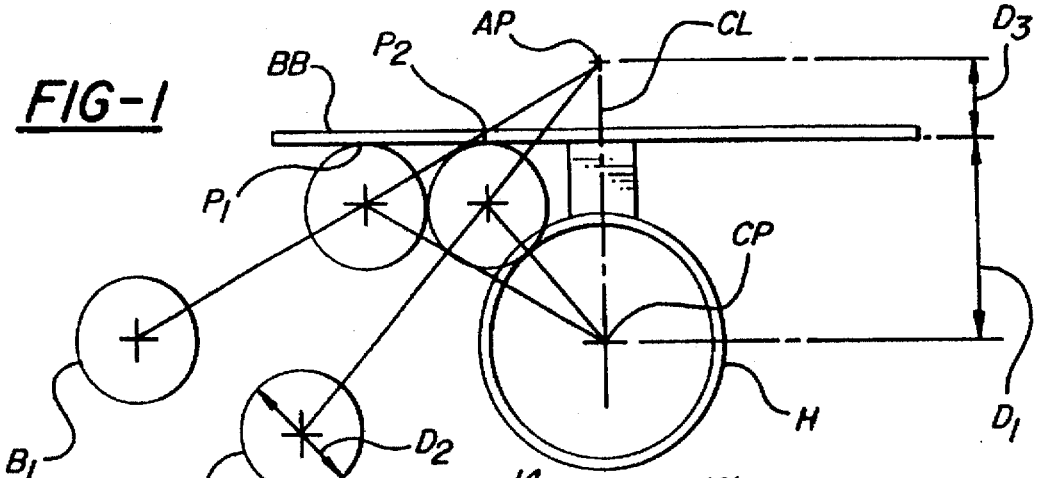
FIG. 1 is a plan view of a basketball rim and backboard depicted in schematic fashion and showing two basketballs being banked into the basket from different positions.

Throughout the following detailed description, like numerals are used to reference the same element of the present invention shown in multiple figures thereof. Referring now to FIG. 1, there is depicted a plan view of a basketball hoop H and a backboard BB. FIG. 1 shows two basketballs $B_1$ and $B_2$ being banked from different positions. To properly bank the basketball, the horizontal component of aiming is a function of three factors: first, the position of a player on the court relative to the hoop H and backboard BB; secondly, the distance $D_1$ between the backboard BB and the centerpoint CP of the hoop H; and third, the diameter $D_2$ of the ball $B_1$ or $B_2$. For a very small ball, the horizontal component of the common aiming point P for these bank shots is approximated by projecting an imaginary basket behind the plane of the front face of the backboard. For a larger ball, such as a basketball, the aiming point AP can be approximated by subtracting ball diameter $D_2$ from $D_1$ to derive $D_3$. A centerline CL is drawn from centerpoint CP through backboard BB and perpendicular with respect thereto. Aiming point AP falls along centerline CL at the distance $D_3$ behind backboard BB, as is clearly shown in FIG. 1.

Aiming point AP can then be used to determine the point on the backboard BB which the ball should strike to correctly bank a shot from any position on the court. For example, a player standing in the position represented by ball $B_1$ can correctly bank the shot into the hoop H if the ball is thrown along a line between the ball $B_1$ and the aiming point AP. That is, ball $B_1$ must strike the backboard at point $P_T$ in order to bank correctly into the hoop. Similarly, a player who is in the court position represented by ball $B_2$ (which is somewhat closer to the center line of the court) must throw the ball along a line drawn between the center of the ball $B_2$ and the aiming point AP. Thus, ball $B_2$ must be thrown so that it strikes the face of the backboard BB at point $P_2$ to bank the ball correctly into the hoop H.

The foregoing discussion shows that the calculation of the correct spot which the ball must strike the backboard in a bank shot as a player moves around the court is complex and multistep. Of course, a real life player cannot be expected to perform these calculations while playing. Typically, players develop expertise over time by practicing bank shots to learn this largely nonintuitive skill.

Figure 2:
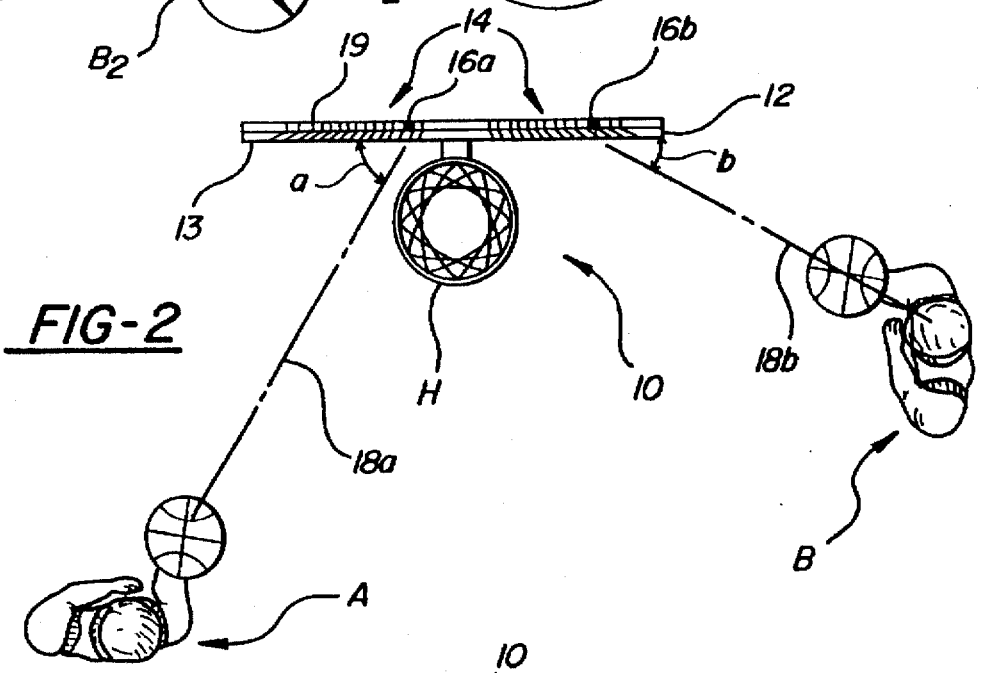
FIG. 2 is a plan, schematic view of a portion of a basketball court showing two players in different positions for selective viewing of two different targets disposed on the backboard of the present invention.

FIG. 2 is a plan view somewhat similar to FIG. 1 but shows an embodiment 10 of the basketball backboard aiming device of the present invention in use. The device 10 includes a backboard member 12 to which is attached a standard basketball hoop H (including net). The backboard member 12 has a front surface 13 which defines a plane.

A linear array of indicia 14 are disposed along the backboard member 12. In this embodiment, the backboard member 12 is transparent and the linear array 14 is disposed behind the backboard 12 for selective viewability. Alternatively, the array could be disposed in front of the backboard member, or embedded therein. The array 14 includes a plurality of individual targets 16 (more clearly visible in FIG. 3) arrayed along each side of the hoop H. Each of the targets 16 is selectively viewable by a shooter disposed along a unique axis formed by a preselected angle with respect to the plane of the backboard member 12, one side of the angle being defined by a line of sight extending from the shooter to the target, and a second side by the plane.

For example, as is depicted in FIG. 2, shooter A is positioned such that his line of sight to target **16*a* is represented by reference numeral 18*a*. 18*a* forms angle a with the front face 13 of backboard member 12. When player A is in any position along line of sight 18*a*, only target 16*a* will be visible to him. Thus, in order to make a bank shot when in any position along line of sight 18***a*, the player must aim the ball so that it strikes target 16*a*, the only target which is visible along this line of sight. In this case, the target 16*a* is quite close to hoop H so that the ball must be very sharply banked in order for it to fall into the hoop H.

In contrast, the player B has a different angular relationship with respect to the backboard 12. In this case, her line of sight is defined by reference numeral 18*b*. A player who stands in any position along line of sight 18*b* will see target 16*b*; the rest of the targets will be invisible to her. Thus, the player will note that she must aim the ball so that it strikes the backboard at target 16*b* in order to correctly bank the ball into the hoop H. In this case, the player B is much farther to the side of the hoop and the ball is, consequently, much less sharply banked than was the case for player A.

It should be noted that targets 16*a* and 16*b* will be selectively viewable by players at varying distances from the backboard 12. That is, as long as player A maintains the same angular relationship with respect to the backboard defined by angle a, he can move back and forth along line of sight 18*a* and still see target 16*a*, and only target 16*a*. The same is true for all of the other plurality of targets 16, each one of which has a corresponding line of sight, the angular relationship of which with respect to the plane of the backboard changes as one moves outboard along each side of the linear array from the hoop toward the ends thereof.

Thus, rather than having to guess or calculate the correct aiming point, a shooter simply views whichever of the array 14 of targets 16 is visible from where he is standing. The backboard member 12 of the present invention has built into it the angular calculations previously explained for each possible position on the court.

Figure 3:
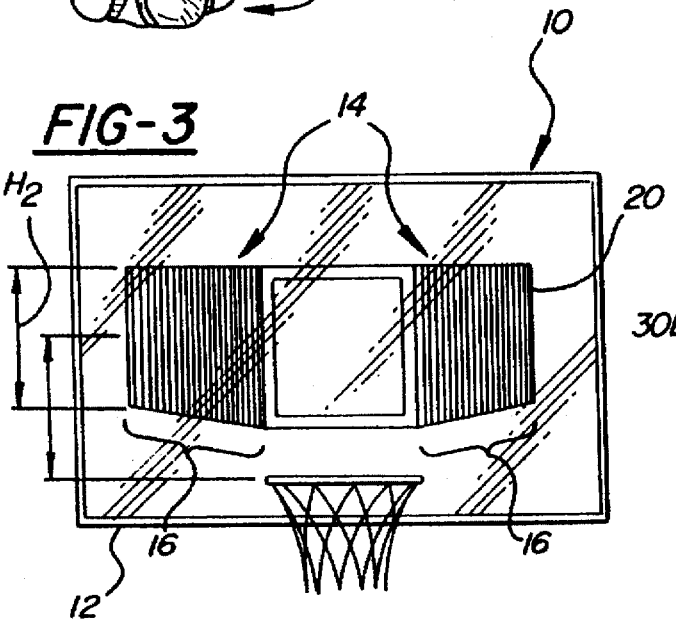
FIG. 3 is an angled perspective view of a basketball backboard constructed according to the principles of the present invention.

FIG. 3 is a front perspective view of a basketball backboard 10 depicting a simple embodiment of the present invention. The vertical component of aiming depends upon numerous factors, including the trajectory of the ball, the player's height, and the player's distance from the backboard. In the embodiment depicted in FIG. 3, the height above the rim of the center of the target $H_1$ and the height of the vertical center of the target$_2$ H are determined by field testing with actual players and coaches. The target 16 can be subdivided into two or more discreet vertical sections 17*a* and 17*b* to provide additional information to the shooter. Over time, the shooter will be able to determine which vertical section 17*a*, 17*b* best applies to her physical height and shooting style (trajectory, etc.). The horizontal locations and widths of the targets 16 are a function of the width of the backboard and the results of field testing with actual players and coaches.

In the embodiment depicted in FIG. 2, a film 19 is affixed to a rear surface of the backboard member 12 by means of adhesive 21. The film 19 can be a lenticular array plastic film to permit selective viewing of the targets 16. It can be printed on its smooth side to achieve an animation effect. Alternatively, film 19 can be a holographic film which includes an interference pattern formed thereon to permit selective viewing of the targets 16. Preferably the holographic film is formed by microembossing a diffraction pattern thereon from a master embossing die, according to a method such as that disclosed in U.S. Pat. No. 4,547,141 discussed previously. U.S. Pat. No. 5,369,511 discloses a technique for creating holographs viewable from different angles in ambient light. The disclosure of both of these patents is hereby incorporated by reference.

Another embodiment 110 of the present invention is depicted in FIG. 4. In this embodiment, a plurality of vertical louvers 22 are mounted behind the surface of the clear backboard. Optionally, the louvers 22 could also be installed in an opaque backboard by inserting clear panels flush with the front surface and mounting the louvers behind the sections. The angles $a_1$ through $a_n$ formed by the louvers and the plane of the backboard are determined by projecting lines $L_1$ and $L_N$, respectively, from centerpoint CP through the plane of the backboard. The number of louvers 22 and the louver spacing are determined from field testing actual players and coaches and should be such that an approximately equal target width throughout the total target area is maintained. The louvers 22 are disposed in front of the targets 16 such that each target 16 is disposed between an adjacent pair of louvers 22.

Figure 6:
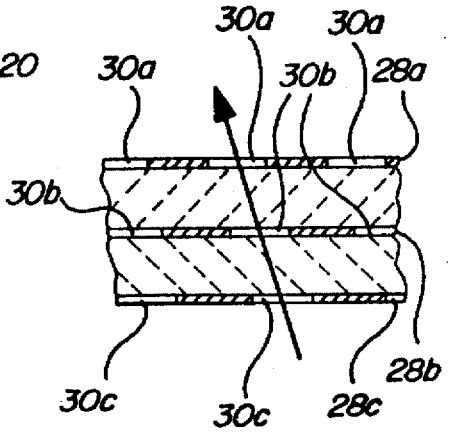
FIG. 6 is a detail view of a portion of yet another embodiment of the backboard of the present invention.

Yet another embodiment is depicted in FIG. 6. Three layers 28*a*, 28*b*, 28*c* of graphic shutters simulate the effect of louvers. Each layer 28*a*, 28*b*, 28*c* of film has opaque regions interspersed with apertures 30*a*, 30*b*, 30*c*, respectively. The respective apertures (for example 30*a*, 30*b*) of adjacent layer pairs (28*a*, 28*b*) are staggered and partially overlapping with respect to each other. Thus, an angled viewing window is defined by each set of three partially overlapping apertures so as to simulate the effect of louvers. In FIG. 6, the arrow shows the line of sight through the apertures 30*a*, 30*b*, 30*c*. A target (not depicted) disposed immediately behind aperture 30*a* will be visible to a shooter along the line of sight defined by the arrow.

Another embodiment 120 of the backboard apparatus of the present invention is depicted in FIG. 5. In FIG. 5, a light control film in the form of fixed louver film 24 is applied to a mounting frame (not depicted) and disposed behind the transparent backboard (or opaque backboard with a window for the target area). The louver film 24 is mounted in a curved fashion behind the backboard so as to vary the angular relationship of the louvers with respect to the backboard in a known and predictable fashion. Thus, the microlouver film approximates the varying angles at which the louvers 22 of the FIG. 4 embodiment are disposed. Preferably, a three sided enclosure 26 is provided to keep out ambient light. Lenticular plastic film is printed on its smooth side to achieve an animation effect similar to the louvers. The targets in this approach can be enhanced with color and even artwork, providing a wide variety of target sizes and shapes.

Obviously, many design approaches are possible with the various embodiments of the backboard apparatus of the present invention. For example, the device can be sold as an integral unit, or be made to be retrofit to existing backboards. If the device is sold as an original unit, the aiming device can be added during the molding of a fiberglass or plastic backboard (such as by in-molding or insert molding). In the louver or lenticular array embodiments, these components can be designed into the mold tooling for injection molded backboards. The holographic or microlouver film can be adhesively bonded during the manufacturing process. Additionally, the targets can be mechanically mounted behind a clear backboard or transparent window in an opaque backboard.

Preferably, the device can be easily removed and/or disabled when the players do not wish to use it, such as during an actual game. Examples of options for accomplishing an aiming device that can be disabled include: a cartridge system that allows the user to pull the aiming device out of a frame within the backboard, or slide a panel in front of the aiming device; a low tack adhesive applied to the back of holographic or lenticular film that allows the user to mount the aiming device on the face of the backboard (or rear) and remove it as desired (mounting guides can be provided for proper orientation); mechanical fasteners for second surface mounting of the system, such as mating hook and loop fasteners, suction cups, snap fits, or threaded fasteners; and in the case of the louver embodiment, the louvers can be pivoting or sliding to be selectively opened or closed.

A wide variety of designs can be implemented for the target array. For example, a circular target that appears to move horizontally (and vertically if the target array is provided as a two-dimensional array), can indicate the proper aiming target. The target can be a vertical line target that moves horizontally, and the vertical line can be segmented into two or more segments that provide further guidance to users. Over time, players will determine which vertical segment is the optimal aiming point. Also, any variety of graphic images, such as a basketball, or a company or team logo, etc. can be incorporated to provide a target for aiming. The target can further be enhanced by depicting the proper trajectory curve from the target to the center of the rim as an additional guide to the players. Clearly, all such design variations, as well as others not mentioned, are within the present invention.

Thus, while the present invention has been described with regard to certain embodiments and exemplifications therein, this description is not intended to limit the scope of the present invention to the exact embodiments and exemplifications depicted. Thus, it is the claims appended hereto, and all reasonable equivalents thereof, rather than the exact depicted embodiments and exemplifications, which define the true scope of the present invention.

We claim:

1. A backboard apparatus for improving the aim of a basketball shooter comprising:

a backboard member for attachment to a standard basketball hoop, said backboard having a front surface defining a plane;

a linear array of indicia disposed along said backboard, said array including a plurality of individual targets; and means for allowing a different one of said targets to be viewable by a shooter disposed along each of a plurality of axis forming a plurality of preselected angles with respect to said plane, one side of each angle being defined by a line of sight extending from said shooter to said target and a second side by said plane and for obscuring all the others of said targets from view by the shooter at each angle.

2. The backboard apparatus of claim 1 wherein said means for allowing and obscuring comprises a lenticular array disposed over said indicia.

3. The blackboard apparatus of claim 2 wherein said lenticular array is formed of lenticular plastic film.

4. The backboard apparatus of claim 1 wherein said means for allowing and obscuring comprises a holographic film disposed on said backboard, said holographic film including an interference pattern forming said plurality of target indicia.

5. The backboard apparatus of claim 1 wherein said means for allowing and obscuring comprises a plurality of vertically extending louvers disposed over said indicia such that each target member is disposed between an adjacent pair of louvers.

6. The backboard apparatus of claim 5 wherein angles formed between the louvers and the plane of the backboard gradually increase from a midpoint of the linear array of target indicia toward each end thereof.

7. The backboard apparatus of claim 6 wherein said plurality of louvers are formed by microlouver film disposed behind said backboard in curved fashion so as to form said gradually increasing angles.

8. The backboard apparatus of claim 1 wherein said backboard is transparent and further comprises a plurality of opaque layers, said means for allowing and obscuring comprising said opaque layers each having a plurality of vertically extending apertures formed therein, the respective apertures of adjacent layer pairs being staggered and partially overlapping with respect to each other, each of said target members being selectively viewable through the respective apertures of one of said adjacent layer pairs.

9. The backboard apparatus of claim 1 further comprising means for attaching said linear array to said backboard member.

10. A backboard apparatus for improving the aim of a basketball shooter comprising:

a backboard member for attachment to a standard basketball hoop, said backboard member having a front surface defining a plane; and a two dimensional array of target indicia disposed on said backboard, said two dimensional array including:

a first plurality of horizontal targets;

a second plurality of vertical targets; and means for allowing a different one of said targets to be viewable by a shooter disposed along different ones of combinations of a first horizontal axis forming a preselected horizontal angle with respect to said plane, a first side of said horizontal angle being formed by a line of sight extending from said shooter to said target and a second side by said plane, and a first vertical axis forming a preselected vertical angle with respect to said plane, a first side of said vertical angle being formed by a line of sight extending from said shooter to said target and a second side by said plane and for obscuring all others of the targets from view of the shooter in each combination of axis.

* * * * *